US010323657B2

(12) United States Patent
Schulz et al.

(10) Patent No.: US 10,323,657 B2
(45) **Date of Patent: *Jun. 18, 2019**

(54) SYSTEM FOR IMPROVING THE ENERGY EFFICIENCY IN HYDRAULIC SYSTEMS

(71) Applicant: Hydac Fluidtechnik GmbH, Sulzbach/Saar (DE)

(72) Inventors: Frank Schulz, Blieskastel-Bierbach (DE); Peter Bruck, Althornbach (DE)

(73) Assignee: HYDAC FLUIDTECHNIK GMBH, Sulzbach/Saar (DE)

( * ) Notice: Subject to any disclaimer, the term of this patent is extended or adjusted under 35 U.S.C. 154(b) by 280 days.

This patent is subject to a terminal disclaimer.

(21) Appl. No.: 13/261,912

(22) PCT Filed: Nov. 9, 2012

(86) PCT No.: PCT/EP2012/004654

§ 371 (c)(1),
(2) Date: May 30, 2014

(87) PCT Pub. No.: WO2013/079151

PCT Pub. Date: Jun. 6, 2013

(65) Prior Publication Data

US 2015/0152889 A1 Jun. 4, 2015

(30) Foreign Application Priority Data

Dec. 3, 2011 (DE) ..... 10 2011 120 226

(51) Int. Cl.
*F15B 1/02* (2006.01)
*F15B 3/00* (2006.01)
(Continued)

(52) U.S. Cl.
CPC ..... *F15B 3/00* (2013.01); *F15B 1/024* (2013.01); *F15B 11/032* (2013.01);
(Continued)

(58) Field of Classification Search
CPC ..... F15B 2211/216; F15B 11/024
See application file for complete search history.

(56) References Cited

U.S. PATENT DOCUMENTS 3,945,207 A * 3/1976 Hyatt ..... B60K 6/12 417/225
4,744,218 A * 5/1988 Edwards ..... G05B 19/414 172/2

(Continued)

FOREIGN PATENT DOCUMENTS

DE 100 06 013 A1 8/2001

*Primary Examiner* — F Daniel Lopez
(74) *Attorney, Agent, or Firm* — Wenderoth, Lind & Ponack, L.L.P.

(57) ABSTRACT

A system for hydraulic systems includes a working cylinder (58) which operates as a consumer of hydraulic energy or as a generator of hydraulic energy. A hydraulic accumulator (1) can be charged by the working cylinder for storing energy and can be discharged for delivering energy to the working cylinder (58). One hydraulic accumulator is provided in the form of an adjustable hydropneumatic piston accumulator (1), in which with a plurality of pressure chambers (19, 21, 23, 25) adjoining effective surfaces (11, 13, 15, 17) of different sizes are on the fluid side of the accumulator piston (5). An adjusting arrangement (51) connects a selected pressure chamber (19, 21, 23, 25) or a plurality of selected pressure chambers (19, 21, 23, 25) of the piston accumulator (1) to the working cylinder (58) as a function of the pressure level that prevails respectively on the gas side of the piston accumulator (1) and on the working cylinder (58).

6 Claims, 4 Drawing Sheets

(51) Int. Cl.

| | |
|---|---|
| ***F15B 21/14*** | (2006.01) |
| ***F15B 11/032*** | (2006.01) |
| ***F15B 11/072*** | (2006.01) |
| *F15B 1/24* | (2006.01) |

(52) U.S. Cl.
CPC ..... *F15B 11/072* (2013.01); *F15B 21/14* (2013.01); *F15B 1/24* (2013.01); *F15B 2201/205* (2013.01); *F15B 2201/31* (2013.01); *F15B 2201/41* (2013.01); *F15B 2211/216* (2013.01); *F15B 2211/30525* (2013.01); *F15B 2211/5152* (2013.01)

(56) References Cited

U.S. PATENT DOCUMENTS

| | | | | | |
|---|---|---|---|---|---|
| 4,760,697 | A * | 8/1988 | Heggie | B60K 6/12 | 180/165 |
| 5,971,027 | A | 10/1999 | Beachley | | |
| 6,502,393 | B1 * | 1/2003 | Stephenson | F15B 11/006 | 60/414 |
| 6,640,163 | B1 * | 10/2003 | Pfaff | G05B 19/05 | 700/11 |
| 8,959,905 | B2 * | 2/2015 | Baltes | B60K 6/12 | 60/414 |
| 9,631,647 | B2 * | 4/2017 | Schulz | F15B 21/14 | |
| 2009/0241534 | A1 * | 10/2009 | Tikkanen | B60K 6/12 | 60/413 |

* cited by examiner

SYSTEM FOR IMPROVING THE ENERGY EFFICIENCY IN HYDRAULIC SYSTEMS

FIELD OF THE INVENTION

The invention relates to a system for improving the energy efficiency in hydraulic systems. At least one working cylinder operates as a consumer of hydraulic energy in one operating state and as a generator of hydraulic energy in another operating state. A hydraulic accumulator can be charged by the working cylinder for storing energy in one operating state of the working cylinder, and can be discharged for delivering energy to the working cylinder in another operating state.

BACKGROUND OF THE INVENTION

Given the increasing scarcity of resources and the increased efforts to save energy associated therewith, systems of the type described above are becoming increasingly important. For this reason, such systems are frequently used in hydraulic equipment and systems, in which actuators in the form of working cylinders are provided. In the case of raising and lowering applications, the potential energy of a load that has been lifted can thereby be converted into hydraulic energy by the working cylinder, which energy can be stored and fed back. Such a system can also be used for load compensation.

In the relevant systems of this kind from the prior art, the efficiency of the energy conversion leaves something to be desired. One reason for this problem is the dependency of the charging and discharging processes of the hydraulic accumulator on the respective system pressure. More specifically, the hydraulic accumulator can only be charged when the system pressure is greater than the gas pressure present in the accumulator on the gas side. If the system pressure cannot be established in the respective operating situation of the working cylinder, it will not be possible to acquire energy in the accumulator. The discharging process of the accumulator is thus subject to limitation if energy from the accumulator can only be fed back when the accumulator pressure is greater than the current system pressure. An additional problem is that, in the case of an accumulator pressure that is greater than the current, needed system pressure at the working cylinder, the pressure level of the accumulator and the system needs to be balanced by valves. The energy, which is latent in the differential pressure between the accumulator pressure and the system pressure, is then lost as a result of throttling losses.

DE 100 06 013 A1 discloses a device for saving energy in hydraulically actuated work equipment through the use of a piston accumulator. In the known solution, a fluid control has a control device, by which the piston accumulator can be connected to, or disconnected from, a fluid circuit of the work equipment. The control device has a monitoring device for such switching operations, which monitoring device at least detects system conditions of the work equipment and/or of the piston accumulator. The device for saving energy then is only used when an actuation of the work equipment appears to be necessary during normal operation. Special operations with the machine, in which the work machine is completely unloaded or very heavily loaded, are not hindered. A favorable energy conversion is thereby achieved with the known solution.

SUMMARY OF THE INVENTION

An object of the invention is to provide an improved system of the type under consideration that allows an even more favorable energy conversion.

This object is basically achieved according to the invention by a system, which has at least one hydraulic accumulator providing an adjustment option. The accumulator provides a plurality of pressure chambers, which are adjacent to active surfaces of different sizes on the fluid side of the accumulator piston. An adjustment assembly is provided, which adjustment assembly connects a selected pressure chamber or a plurality of selected pressure chambers of the piston accumulator to the working cylinder, depending on the respective prevailing pressure level on the gas side of the piston accumulator and at the working cylinder. This arrangement provides the possibility of recycling energy regardless of the pre-charge pressure on the gas side of the accumulator and independently of the respective load pressure, because the respective desired pressure level at the accumulator can be used for charging or discharging by selecting an active surface of the appropriate size. An optimal energy conversion is thereby possible for all operating states.

In addition, the use of such a "multi-step accumulator" allows influencing the loading time by selecting the effective surfaces. If a small surface is selected at a constant volume flow for example, this situation will result in a short loading time of the accumulator. If a large surface is selected at a constant volume flow, this situation will result in a longer loading time. A finer or coarser pressure gradation can be obtained by forming a larger or smaller number of pressure chambers of different effective piston surfaces. More than one accumulator having different pressure chambers could also be provided to achieve particularly high degrees of resolution.

In an especially advantageous manner, a control logic unit may be associated with the adjustment assembly, which logic unit processes the signals from sensor devices for the control of the valves associated with the adjustment assembly. The sensor devices display or provide a signal representative the pressure level on the gas side of the piston accumulator and the respective operating state of the working cylinder. The logic unit thereby controls the energy transformation by deciding how the accumulator should be charged or discharged based on the load condition at the working cylinder and the load condition at the accumulator. In so doing, the user can influence the logic unit by entering his own presets, and thereby, determine the load characteristic of the system.

With regard to the construction of the piston accumulator, advantageously the accumulator piston is configured as a step piston for the formation of active surfaces of different sizes. The piston has partial piston surfaces that are adjacent to cylinder surfaces on the fluid side thereof. The accumulator housing has corresponding mating surfaces that are adjacent to cylinder surfaces. The mating surfaces together with partial piston surfaces associated therewith each delimit separate pressure chambers.

Active surfaces on the accumulator piston and mating surfaces on the accumulator housing are preferably disposed at an axial spacing to one another. The active surfaces and mating surfaces may be provided in the form of annular surfaces or circular surfaces, which are disposed concentrically to the longitudinal axis.

In terms of controlling the pressure chambers of the piston accumulator, advantageously the adjustment assembly has selector valves, by which the respective pressure chambers of the piston accumulator, which are selected for charging or discharging, can be connected to the working cylinder, and the remaining pressure chambers can be connected to the tank. Controlled by the control logic unit, a selected pressure chamber or a combination of selected pressure chambers can be connected to the working cylinder for charging or discharging. Non-selected pressure chambers can be emptied without pressure to the tank during the discharging of the active pressure chamber, and refilled from the tank during the charging of the active pressure chambers.

In terms of the supply of signals to the control logic unit, advantageously the associated sensor device has at least pressure sensors, which provide signals to the control logic unit. Those signals indicate the filling pressure on the gas side of the piston accumulator and the system pressure at the working cylinder. In addition, a position sensor is preferably provided at the working cylinder, which signals the piston position and/or piston speed of the working cylinder.

In especially advantageous embodiments, the adjustment assembly comprises a main line that is connected to the pressure side of a hydraulic pump, as well as connecting lines that run therefrom to the fluid ports of the piston accumulator. These connecting lines can each be selectively blocked, released or connected to the tank by the switching valves.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
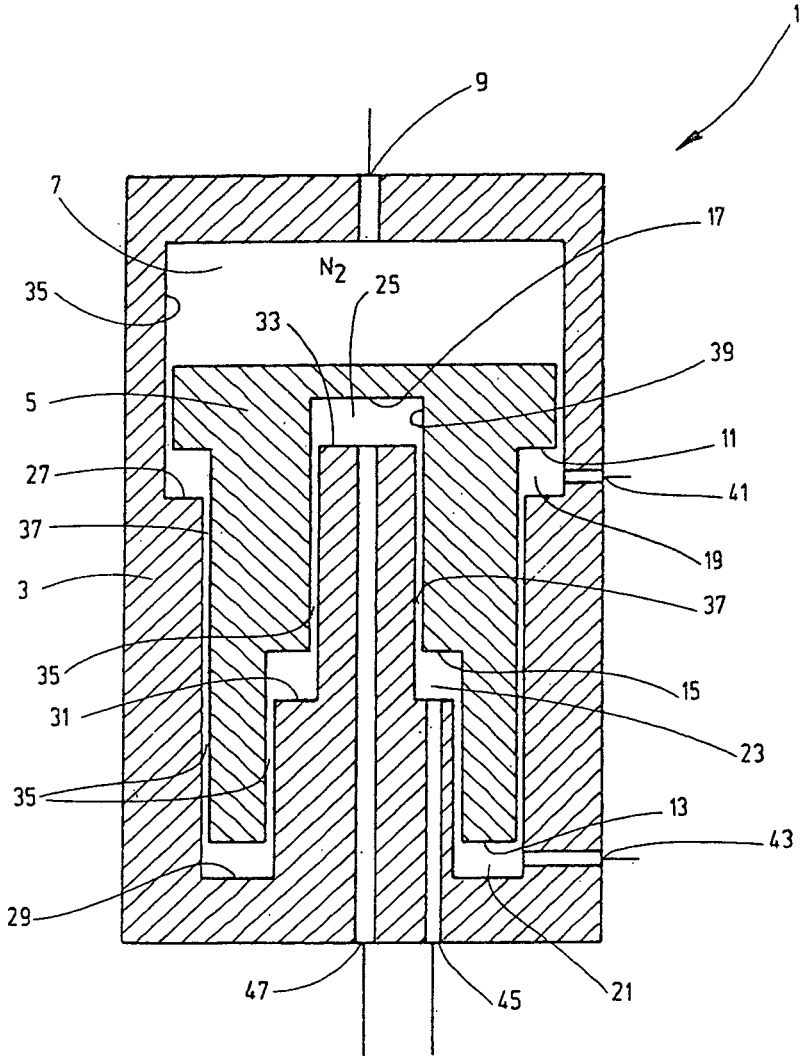
FIG. 1 is a highly schematic, side view in section of an exemplary embodiment of a hydropneumatic piston accumulator in a multi-stage design for use in the system according to the invention.

The hydropneumatic piston accumulator 1, which is shown in a schematic, simplified depiction in FIG. 1, has an accumulator piston 5 that is axially movably guided in an accumulator housing 3. The accumulator piston 5 separates a gas side 7, on which a filling port 9 is located, from fluid-side pressure chambers in the accumulator housing 3. The accumulator piston 5 is configured in the manner of a step piston such that, in combination with corresponding stepped portions of the accumulator housing 3, the accumulator piston delimits fluid-side pressure chambers 19, 21, 23 and 25, which are adjacent to active surfaces 11, 13, 15 and 17 of different sizes on the fluid side of the accumulator piston 5. In FIG. 1, these active surfaces 11, 13, 15 and 17 are arranged in order from the largest surface to the smallest surface. Here, the active surfaces 11, 13 and 15 are each formed by annular surfaces disposed concentrically relative to the longitudinal axis, which surfaces surround the innermost active surface 17 in the form of a circular surface. Pressure chambers 19, 21 or 23, respectively, which are adjacent to the active surfaces 11, 13 and 15, are delimited by mating surfaces 27 or 29 or 31, respectively, of the accumulator housing 3, as well as by cylinder surfaces 35 of the cylinder housing 3 and cylinder surfaces 37 on the accumulator piston 5.

The pressure chamber 25 adjacent to the active surfaces 17 is delimited by a mating surface 33 of the accumulator housing 3, as well as by a cylinder surface 39 of the accumulator piston 5.

A fluid port 41, 43, 45 or 47, respectively, is provided for each pressure chamber 19, 21, 23, 25. Just as the active surfaces 11, 13, 15 and 17 are disposed on the accumulator piston 5, the associated mating surfaces 27, 29, 31 or 33, respectively, are disposed on the accumulator housing 3 in steps that are axially spaced relative to one another.

Figure 2:
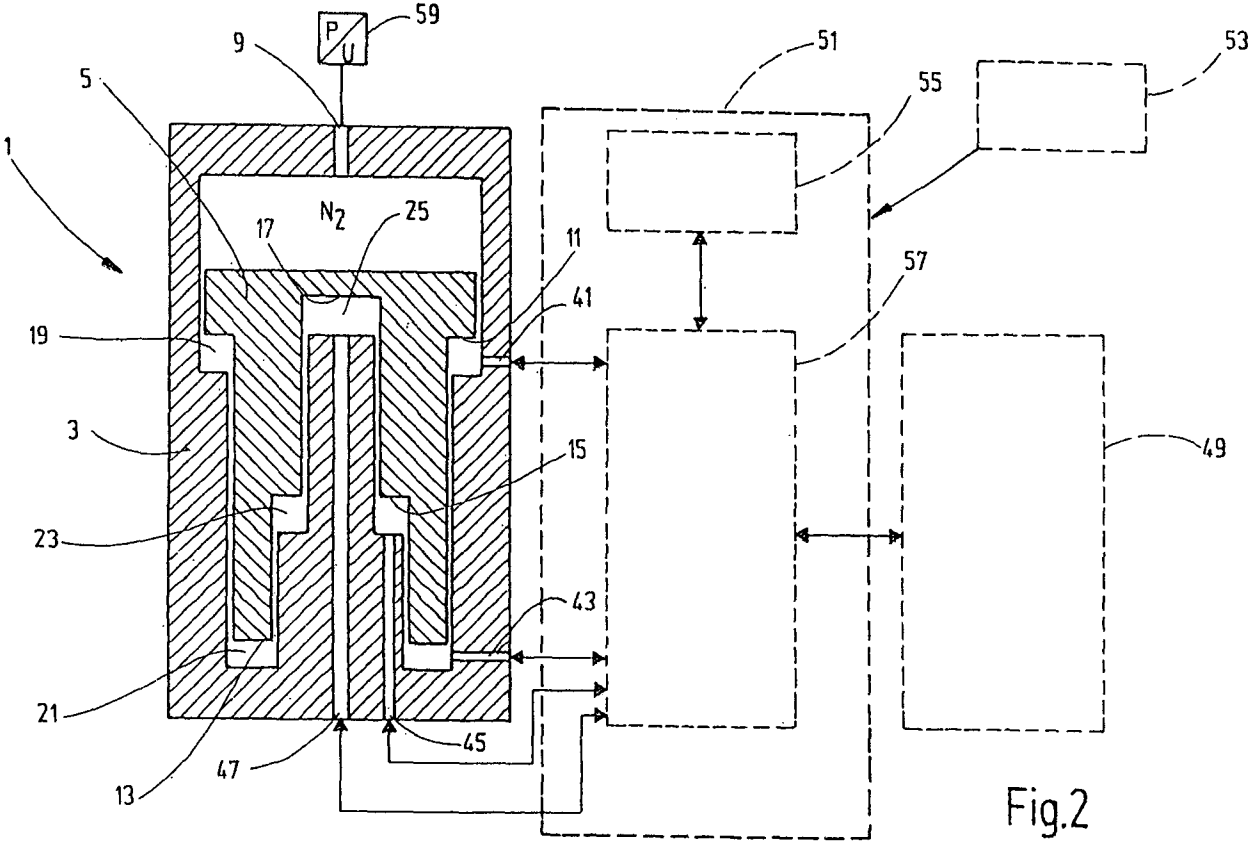
FIG. 2 is a schematic diagram that shows the piston accumulator from FIG. 1 in conjunction with associated system components of the system according to an exemplary embodiment of the invention.

FIG. 2 shows the piston accumulator 1 in conjunction with associated system components. An actuator 49 is operatively connected to an adjustment assembly 51. As already noted, a working cylinder 58 (FIG. 3) may be provided as an actuator 49, which cylinder may be a component in a raising and lowering assembly, for example. A control logic unit 53 is associated with the adjustment assembly 51, which logic unit actuates a valve arrangement 57 of the adjustment assembly 51 by a control and regulation unit 55. As will be explained in greater detail on the basis of FIGS. 3 and 4, the valve arrangement 57 has selector valves, which produce selected fluid connections between the actuator 49 and the fluid ports 41, 43, 45, 47 of the piston accumulator 1 to selectively activate the pressure chambers 19, 21, 23 and 25 for charging and discharging processes. To this end, the control logic unit 53 processes signals, which are provided by sensor devices and which represent the operating states of actuator 49 and piston accumulator 1. Only one of the sensor devices, a pressure sensor 59 at the filling port 9 of the piston accumulator 1, is shown in FIG. 2.

Figure 3:
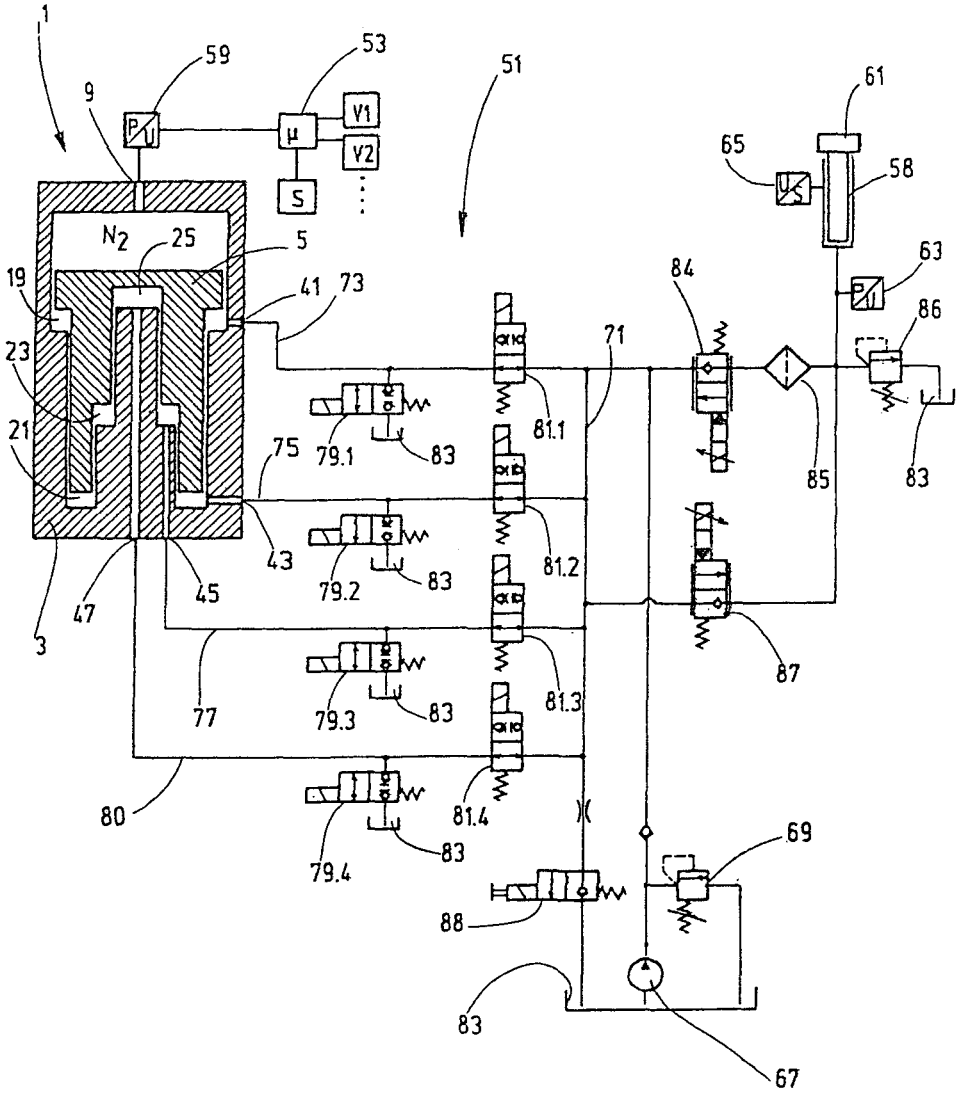
FIG. 3 is a hydraulic diagram of the piston accumulator of FIG. 1 in conjunction with a system for a raising and lowering application according to a first exemplary embodiment of the invention.

FIG. 3 shows the system according to the invention in conjunction with a raising and lowering assembly, wherein the actuator has a working cylinder 58 for raising and lowering a load 61. A pressure sensor 63 that detects the load pressure, and a position sensor 65 that detects a raising and lowering speed are provided on the working cylinder 58, to generate the signals that are to be processed by the control logic unit 53. A hydraulic pump 67, which is secured on the output side by a pressure relief valve 69, is connected to a main line 71 of the adjustment assembly 51, which guides the system pressure. This assembly has connecting lines 73, 75, 77 and 80, respectively, for the connection between the main line 71 and the fluid ports 41, 43, 45 and 47 of the piston accumulator 1. A valve group, which is actuated by the control logic unit 53 actuated, and symbolically designated as $v_1$, $v_2$, etc., is located in each of the connecting lines. Each valve group is formed by two fast switching 2/2-way-valves 79 and 81, which are identified with indices 1 to 4 for the valve groups $v_1$ to $v_4$. Each of the connecting lines can be connected to, or blocked from, the associated fluid port of the piston accumulator 1 by the directional valves 81. The respective connecting line 73, 75, 77, 80 can be connected to the tank 83 by the directional valve 79.

For a lifting process, the main line 71 can be connected to the working cylinder 58 by a valve, which is designed as a proportional choke valve 87 for the control of the lifting speed. The flow is started through the fluid filter 85 when the working cylinder 58 is lowered. In addition, a pressure relief valve 86 is used to secure the relevant hydraulic circuit. The lifting movement is achieved with the aid of the energy stored in the piston accumulator by a discharge process from the selected pressure chamber 19, 21, 23, 25, or from a plurality of selected pressure chambers, which have the appropriate pressure level for the lifting movement of the load 61. In the case of lowering movements, the potential energy of the load 61 is stored as hydraulic energy in the piston accumulator 1. A charging process then occurs by a proportional choke valve 84 that adjusts the lowering speed and a selected connecting line 73, 75, 77, 80, or by a plurality of selected connecting lines to a corresponding fluid port 41, 43, 45, 47. One or more of the directional valves 81 is or are opened, respectively, and directional valves 79 of non-selected connecting lines establish the connection to the tank 83. Through this connection, non-selected pressure chambers 19, 21, 23, 25 of the piston accumulator 1 are depressurized during discharge processes, and can be refilled from the tank 83 during charging processes. A directional valve 88 located on the main line 71 permits depressurizing or emptying of the system as needed.

During operation, in order to lower a load with energy-recovery, the load pressure at the cylinder 58 is transmitted to the control logic unit 53 by the pressure sensor 63. The gas pressure in the accumulator 1 is likewise transmitted, which is determined by the pressure sensor 59. By this information, a decision can be made by the control system, as to how the available potential energy of the cylinder 58 can be optimally fed back into the accumulator 1. In the case of low loads, a large effective surface is selected, in order to charge the accumulator to a high pressure level. If there is a high load 61 on the cylinder 58, the accumulator 1 is charged with a smaller effective surface. The lowering speed of the load is adjusted by the proportional choke valve 84.

The load compensation effected by the system may be done discontinuously by selecting and/or switching the suitable effective surfaces. If a sufficiently large number of pressure levels are provided in the accumulator 1, a resolution can be achieved that allows a load to be smoothly lowered. To lift a load 61, with or without the help of the pump 67, when the piston accumulator 1 is loaded, the appropriate effective surface or effective surfaces are selected according to the load 61 on the cylinder 58 depending on the gas pressure in the accumulator 1. To smoothly start up the movement of the load 61, a lower pressure level is preferably initially selected. The speed of raising the load 61 is adjusted by the proportional choke valve 87. The pressure differential is kept as small as possible by appropriately selecting the effective surfaces of the accumulator 1, so that a low-loss conversion of the stored energy into lifting force is made possible.

Figure 4:
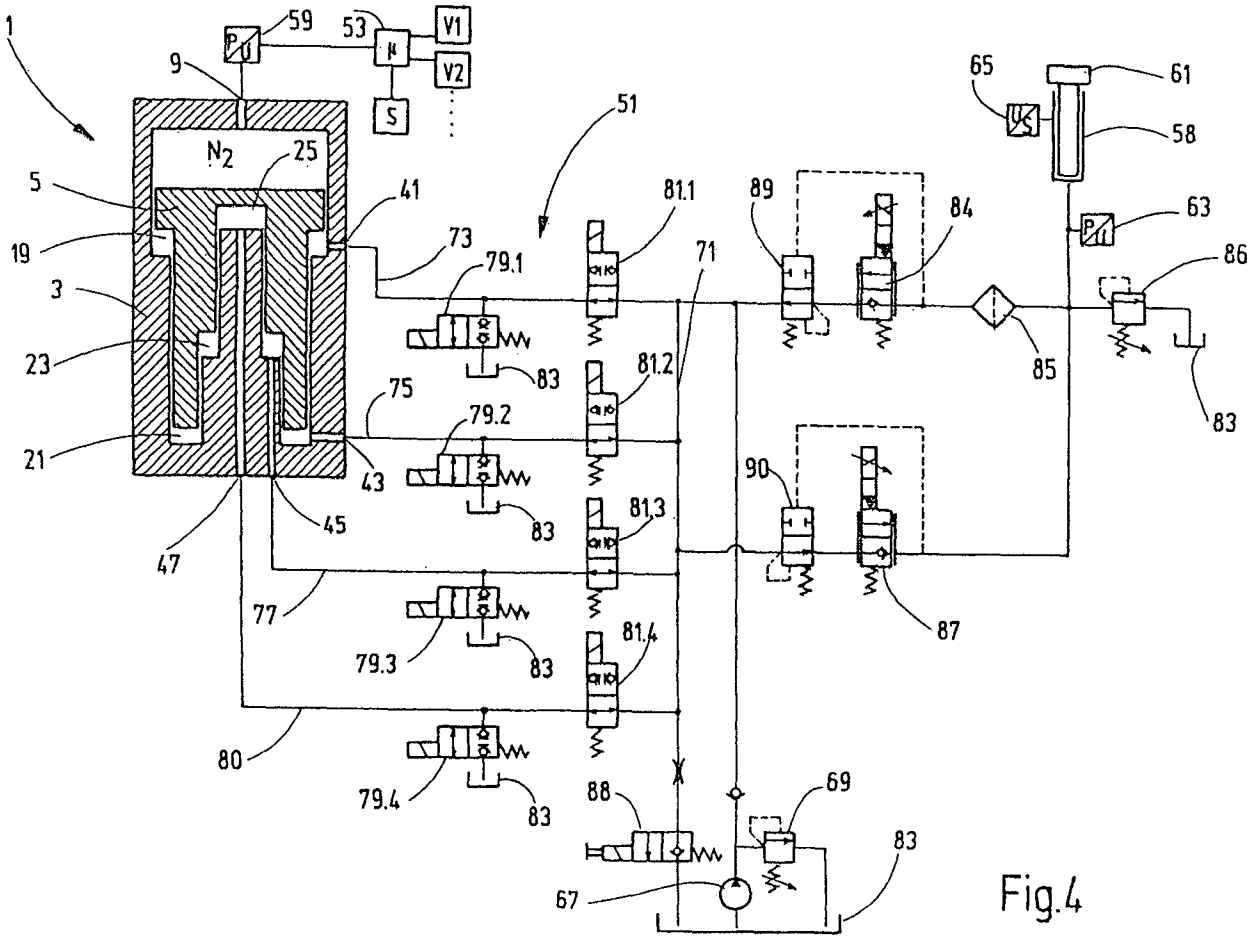
FIG. 4 is a hydraulic circuit diagram of the piston accumulator of FIG. 1 in conjunction with a system for a raising and lowering application according to a second exemplary embodiment of the invention.

The embodiment in FIG. 4 only differs from the example in FIG. 3 in that a pressure maintenance valve 89 or 90, respectively, is provided at each of the proportional choke valves 84 and 87, to create a constant pressure differential at the associated proportional choke valve 84, 87. Jumps in the pressure differential at the respective proportional choke valve 84, 87 can be compensated for by switching the effective surfaces of the accumulator 1.

If fast-switching directional valves 79 and 81 are used instead of the proportional choke valves 84, 87, these directional valves may also be controlled by pulse-width modulation, whereby a desired average flow rate can be adjusted to, depending on the impulse modulation.

While various embodiments have been chosen to illustrate the invention, it will be understood by those skilled in the art that various changes and modifications can be made therein without departing from the scope of the invention as defined in the claims.

The invention claimed is:

1. A system for improving the energy recovery efficiency in hydraulic systems, comprising:

a working cylinder operable as a consumer of hydraulic energy in a first operating state thereof and as a generator of hydraulic energy a second operating state thereof, said working cylinder having a piston movable therein;

a hydraulic accumulator connected to and chargeable by said working cylinder for storing energy from said working cylinder in the second operating state and connected to said working cylinder for discharging and delivering energy to said working cylinder in the first operating state, said hydraulic accumulator being an adjustable hydropneumatic piston accumulator having a plurality of separate fluid pressure chambers formed therein on a fluid side thereof, said fluid pressure chambers adjoining effective surfaces of different sizes, said piston accumulator having a gas side, said piston accumulator having an accumulator piston guided for axial movement in an accumulator housing and separating said gas side from said fluid side in said accumulator housing, said accumulator piston being configured as a step piston with active surfaces of different sizes of said fluid side and arranged in order from a largest active surface to a smallest active surface, at least one of said active surfaces being annular and being disposed concentrically relative to a longitudinal axis of said accumulator piston, said smallest active surface being circular and innermost, the remaining ones of said active surfaces surrounding said smallest active surface, cylindrical surfaces extending between and axially spacing the respective active surfaces, said accumulator housing has stepped portions having a smallest housing surface and other annular housing surfaces corresponding to respective ones of said active surfaces of said step piston and having cylindrical surfaces, extending between and axially spacing the respective housing surfaces, said active surfaces, said housing surfaces and said cylindrical surfaces of said accumulator piston and said accumulator housing delimiting said fluid pressure chambers therebetween, one of said fluid pressure chambers being delimited by said smallest active surface, said smallest housing surface and the respective cylindrical surface of said accumulator piston, fluid ports in said accumulator housing being connected to said fluid pressure chambers;

a gas filling port in said accumulator housing on said gas side;

an adjustment assembly selectively connecting one or more of said fluid pressure chambers of said piston accumulator to said working cylinder depending on pressure levels prevailing on said gas side of said piston accumulator and at said working cylinder, said adjustment assembly having directional valves controlling fluid flow between said fluid pressure chambers of said piston accumulator and said working cylinder and having first and second pressure sensors and a position sensor, said first pressure sensor being directly coupled to said gas side and providing signals representative of pressure levels of said gas side of the piston accumulator, said second pressure sensor providing signals representative of pressure at said working cylinder, said position sensor providing signals representative of movement directions of said piston in said working cylinder; and a control logic unit connected to said adjustment assembly processing the signals received from said sensors and controlling said valves based on the signals via lines connecting said sensors to said control logic unit and connecting said control logic unit to said valves.

2. A system according to claim 1 wherein said valves of said adjustment assembly selectively connect at least one of the fluid pressure chambers for charging and discharging to said working cylinder and connecting remaining ones of said fluid pressure chambers to a tank.

3. A system according to claim 1 wherein said adjustment assembly comprises a main line connected to a pressure side of a hydraulic pump and comprises connecting lines extending from said main line to fluid ports of said piston accumulator, said connecting lines being selectively blocked, released and connected to a tank by said valves.

4. A system according to claim 1 wherein said position sensor detects raising and lowering speeds, is mounted on said working cylinder and provides signals of the raising and lowering speeds to said control logic.

5. A system according to claim 1 wherein parallel first and second fluid lines are connected to said working cylinder, said first and second fluid lines having first and second pressure maintenance valves and first and second check valves, respectively, therein.

6. A hydropneumatic accumulator, comprising:

an accumulator piston guided for axial movement in an accumulator housing and separating a gas side from a liquid side in said accumulator housing;

a gas filling port in said accumulator housing on said gas side;

said accumulator piston being configured as a step piston with active surfaces of different sizes of said liquid side and arranged in order from a largest active surface to a smallest active surface, at least one of said active surfaces being annular and being disposed concentrically relative to a longitudinal axis of said accumulator piston, said smallest active surface being circular and inner-most, the remaining ones of said active surfaces surrounding said smallest active surface, cylindrical surfaces extending between and axially spacing the respective active surfaces;

said accumulator housing having stepped portions having a smallest housing surface and other annular housing surfaces corresponding to respective ones said active surfaces of said step piston and having cylindrical surfaces, extending between and axially spacing the respective housing surfaces, said active surfaces, said housing surfaces and said cylindrical surfaces of said accumulator piston and said accumulator housing delimiting liquid side pressure chambers therebetween, one of said liquid pressure chambers being delimited by said smallest active surface, said smallest housing surface and the respective cylindrical surface of said accumulator piston; and a fluid port in said accumulator housing connected to each of said liquid pressure chambers.

* * * * *